US010038951B1

(12) United States Patent
Cantwell

(10) Patent No.: US 10,038,951 B1
(45) **Date of Patent: *Jul. 31, 2018**

(54) HEADPHONES SYSTEM AND METHOD

(71) Applicant: Alex Cantwell, Naples, FL (US)

(72) Inventor: Alex Cantwell, Naples, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/907,416

(22) Filed: Feb. 28, 2018

Related U.S. Application Data

(63) Continuation of application No. 15/407,061, filed on Jan. 16, 2017, now Pat. No. 9,936,280.

(51) Int. Cl.
*H04R 25/00* (2006.01)
*H04R 1/10* (2006.01)

(52) U.S. Cl.
CPC ..... *H04R 1/105* (2013.01); *H04R 1/1025* (2013.01); *H04R 1/1066* (2013.01)

(58) Field of Classification Search
CPC ..... H04R 1/105; H04R 1/1025; H04R 1/1066
See application file for complete search history.

(56) References Cited

U.S. PATENT DOCUMENTS 4,727,599 A * 2/1988 Rappaport ..... A42B 1/245 2/DIG. 11
6,319,015 B1 * 11/2001 Faunce ..... H01R 11/22 24/662
2017/0333667 A1 * 11/2017 Tucker ..... A61M 21/02

* cited by examiner

*Primary Examiner* — Brian Ensey
(74) *Attorney, Agent, or Firm* — Uradnik Law Firm PC

(57) ABSTRACT

A machine washable headband including a headphones system that is waterproof when submerged up to about one meter deep for up to about thirty minutes, the headphones system including a battery compartment, an electronics and control compartment, an inductive charging antenna, and a pair of speakers.

15 Claims, 3 Drawing Sheets

HEADPHONES SYSTEM AND METHOD

RELATED APPLICATIONS

This application relates and claims priority to, and is a continuation of, U.S. patent application Ser. No. 15/407,061 entitled "Headphones System and Method," filed on Jan. 16, 2017, by Alex Cantwell, now U.S. Pat. No. 9,936,280 issued on Apr. 3, 2018.

FIELD OF THE DISCLOSURE

The invention relates generally to a headphones system and method, and more particularly to a headphones system included within a headband, wherein the headband and headphones system is washing machine washable.

BACKGROUND

Numerous systems and methods exist for providing music, podcasts, and other performances for individual listening. For the sake of convenience only, and without limitation, reference is made herein only to providing music for individual listening, although the invention described herein is not so limited.

Often, headphones systems and methods are used so that music is provided directly to a person's ears. For example, individuals may wear over-the-ears headphones that are connected to a music player by a cable. While some advancements have been made that eliminate the use of cables or other physical links between headphones and a music player (e.g., through the use of WiFi, Bluetooth, or other connection systems), such systems and methods still are not without their drawbacks.

Many headphones systems are not waterproof. Operation of such devices often stops when the headphones system is placed in or otherwise exposed to water. Accordingly, there is no ability to place such headphones systems in an article of clothing that will be laundered, as the act of washing the item ruins the headphones system. Thus, there remains a need for a simple and cost-effective system and method to provide in a washable clothing item a headphones system.

SUMMARY

The present disclosure provides a headband including a headphones system that is machine washable, i.e., the headphones system (and each component thereof) is waterproof for up to about thirty minutes when immersed in water up to about one meter deep. In that way, the headband including the headphones may be laundered as desired in conventional washing machines.

Other benefits and advantages of the present disclosure will be appreciated from the following detailed description.

DETAILED DESCRIPTION

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to headphones use; etc. Such aspects related to this disclosure do not depart from the invention, and it is therefore intended that the invention not be limited by the certain aspects set forth of the events and circumstances related to this disclosure.

Turning now to the drawings, the figures show an exemplary headphones system. The system may be embodied in a washable article of clothing, e.g., a headband. The headphones system is machine washable in that it remains waterproof when submerged in up to about one meter of water for up to about thirty minutes.

Figure 1:
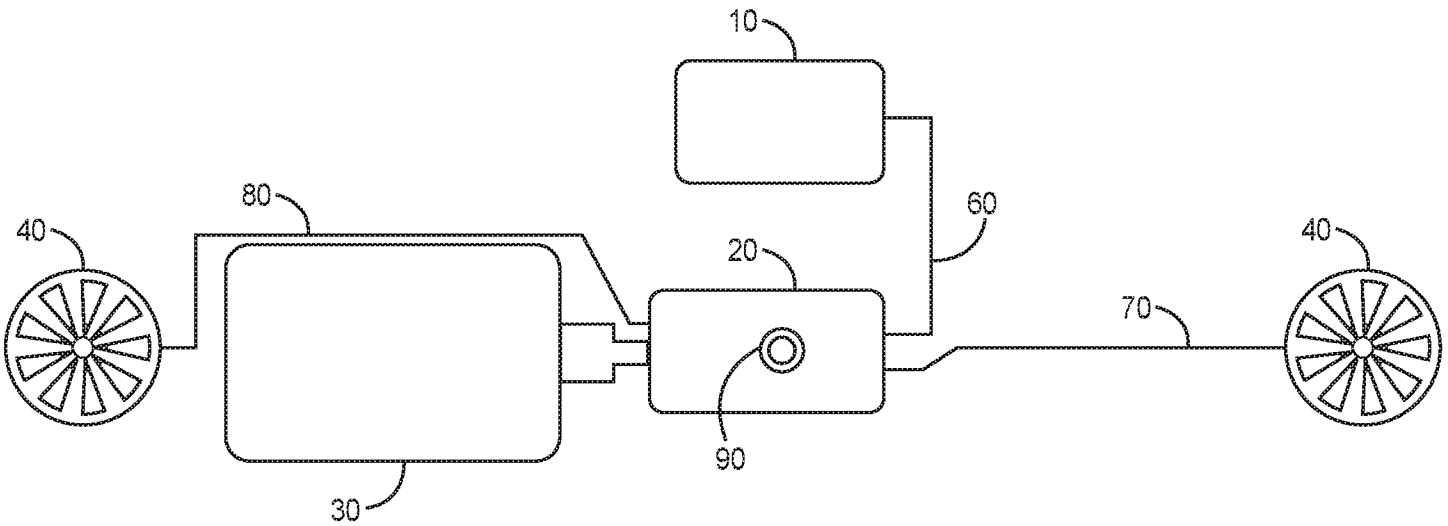
FIG. 1 is a top plan view in partial schematic form of an exemplary embodiment of a headphones system.
Figure 2:
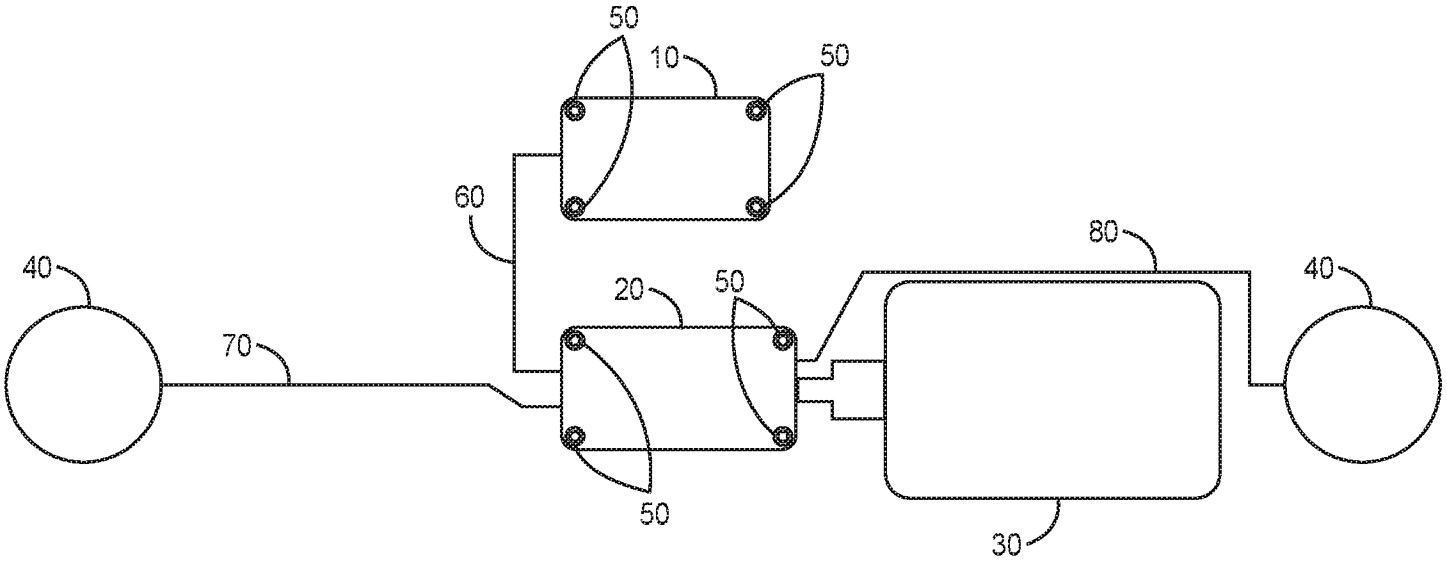
FIG. 2 is a bottom plan view in partial schematic form of the exemplary embodiment of a headphones system shown in FIG. 1.
Figure 3:
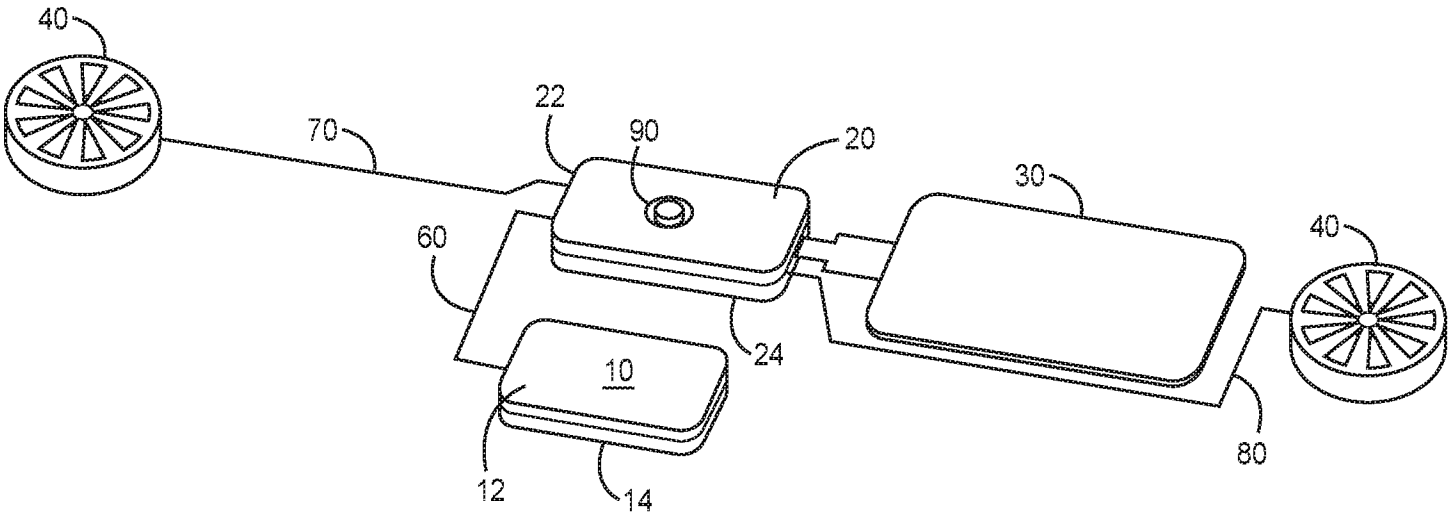
FIG. 3 is a top perspective view in partial schematic form of the exemplary embodiment of a headphones system shown in FIG. 1.

An exemplary embodiment of the headphones system is shown in FIGS. 1, 2 and 3. As described, the headphones module includes four sections: a battery compartment 10; an electronics and control compartment 20; a charging antenna 30; and a pair of speakers 40. As shown in the drawings, the four sections are electrically coupled for operation of the module.

The battery compartment 10 houses a lithium ion battery capable of running the module for up to about six hours. In one embodiment, a 250 mAH battery is used. The form factor of the battery is such that the battery fits within a six millimeter thick housing. The housing includes two generally rectangular sections—an upper section 12 and a lower section 14. The sections may include a mating tongue and groove arrangement about their peripheries. An o-ring may be included for additional waterproofing. The sections may be held together by a screw 50 disposed in each corner of the housing. In an alternate embodiment, the sections may be joined by ultrasonic welding.

A power wire 60 electrically couples the battery compartment 10 and the electronics and control compartment 20. The areas where the power wire 60 meets the battery compartment 10 and electronics and control compartment 20 may be sealed with silicone or another such suitable waterproofing material.

The electronics and control compartment 20 may include an upper housing 22 and a lower housing 24. The housings may include mating tongue and groove portions about their peripheries. An o-ring may be held between the housings to help provide waterproofing. The housings may be held together by screws 50. Alternately, ultrasonic welding my be used to join the housings.

The electronics and control compartment 20 is electrically coupled to speakers 40 by speaker wires 70, 80. The compartment 20 is also electrically coupled to charging antenna 30. The charging antenna 30 may be of the type generally commercially available as part of an inductive charging kit. Again, to promote waterproofing each connection point may be sealed with silicone or with another suitable waterproofing material.

The electronics and control compartment 20 houses the electronics for Bluetooth connectivity, for a battery charging circuit, and for a speakers control circuit. The electronics may be designed into a control board that may be disposed in a six millimeter thick housing. Electrically coupled to the control board is a button 90. The button 90 on the compartment 20 provides power control. The button 90 also activates syncing via Bluetooth between the headphones system and a music device.

To operate the headphones system, the button 90 is depressed once. A chime sounds through the speakers 40 and power is provided to the system electronics. The headphones system automatically enters a discoverable mode so that the system may be paired via Bluetooth with an audio device. A user selects on the audio device to connect the audio device to the headphones system. A chime may sound through the speakers to indicate a successful connection. Once a connection is made (i.e., once the devices are synced) any audio played on the audio device will be transmitted to the headphones system and heard via the speakers 40. Control of music is accomplished on the audio device (e.g., pause, play, rewind, fast forward, song selection, etc.). Then, to turn off the headphones system the button 90 is pressed and held. The system powers off and a chime may be heard to indicate shutdown.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

What is claimed is:

1. A headband including a headphones system including: a waterproof battery compartment electrically coupled to a waterproof electronics and control compartment, the compartment including a control board, the control board including electronics for Bluetooth connectivity; a button electrically coupled to the control board for activating Bluetooth syncing between the headphones system and an audio device; an inductive charging antenna electrically coupled to the electronics and control compartment; and a pair of speakers electrically coupled to the electronics and control compartment; wherein the headband including the headphones system is machine washable.

2. The headband of claim 1, wherein the headphones system is waterproof when submerged up to about one meter deep for up to about thirty minutes.

3. The headband of claim 1, wherein the electronics and control compartment includes first and second housings with an o-ring disposed therebetween, the first and second housings being joined about the housings' peripheries in a tongue and groove configuration.

4. The headband of claim 3, wherein the first and second housings are joined by screws.

5. The headband of claim 1, wherein the electronics and control compartment includes first and second housings ultrasonically welded together.

6. A headband including a headphones system including: a waterproof battery compartment about six millimeters thick electrically coupled to a waterproof electronics and control compartment about six millimeters thick, the compartment including a control board including electronics for Bluetooth connectivity; a button electrically coupled to the control board for activating Bluetooth syncing between the headphones system and an audio device; an inductive charging antenna electrically coupled to the electronics and control compartment; and a pair of speakers electrically coupled to the electronics and control compartment; wherein the headband including the headphones system is machine washable.

7. The headband of claim 6, wherein the headphones system is waterproof when submerged up to about one meter deep for up to about thirty minutes.

8. The headband of claim 6, wherein the electronics and control compartment includes first and second housings with an o-ring disposed therebetween, the first and second housings being joined about the housings' peripheries in a tongue and groove configuration.

9. The headband of claim 8, wherein the first and second housings are joined by screws.

10. The headband of claim 6, wherein the electronics and control compartment includes first and second housings ultrasonically welded together.

11. A headband including a headphones system including: a waterproof battery compartment electrically coupled to a waterproof electronics and control compartment, the compartment including a control board, the control board including electronics for wireless connectivity with an audio device; a button electrically coupled to the control board for activating a wireless connection between the headphones system and the audio device; an inductive charging antenna electrically coupled to the electronics and control compartment; and a pair of speakers electrically coupled to the electronics and control compartment; wherein the headband including the headphones system is machine washable.

12. The headband of claim 11, wherein the headphones system is waterproof when submerged up to about one meter deep for up to about thirty minutes.

13. The headband of claim 11, wherein the electronics and control compartment includes first and second housings with an o-ring disposed therebetween, the first and second housings being joined about the housings' peripheries in a tongue and groove configuration.

14. The headband of claim 13, wherein the first and second housings are joined by screws.

15. The headband of claim 11, wherein the electronics and control compartment includes first and second housings ultrasonically welded together.

* * * * *